US010147357B2

(12) United States Patent
Li et al.

(10) Patent No.: US 10,147,357 B2
(45) Date of Patent: Dec. 4, 2018

(54) PIXEL COMPENSATION CIRCUIT AND DISPLAY DEVICE

(71) Applicant: Wuhan China Star Optoelectronics Technology Co., Ltd., Wuhan (CN)

(72) Inventors: Jun Li, Wuhan (CN); Di Zhang, Wuhan (CN); Guang Li, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 0 days.

(21) Appl. No.: 15/568,800

(22) PCT Filed: May 3, 2017

(86) PCT No.: PCT/CN2017/082821
§ 371 (c)(1),
(2) Date: Oct. 24, 2017

(65) Prior Publication Data

US 2018/0301093 A1 Oct. 18, 2018

(30) Foreign Application Priority Data

Apr. 12, 2017 (CN) ..... 2017 1 0237158

(51) Int. Cl.
*G09G 3/3258* (2016.01)

(52) U.S. Cl.
CPC ... *G09G 3/3258* (2013.01); *G09G 2320/0204* (2013.01); *G09G 2320/045* (2013.01)

(58) Field of Classification Search
CPC ..... G06F 3/0386; G06F 3/0412; G06F 3/042; G09G 3/3233; H01L 27/1446; H01L 27/288; H01L 27/3227
See application file for complete search history.

(56) References Cited

U.S. PATENT DOCUMENTS

| | | | | |
|---|---|---|---|---|
| 8,130,181 | B2 | 3/2012 | Jeon et al. | |
| 9,646,536 | B2 | 5/2017 | Qian et al. | |
| 2005/0285822 | A1* | 12/2005 | Reddy | G06F 3/03542 345/76 |
| 2007/0279937 | A1 | 12/2007 | Hsiao et al. | |
| 2008/0198122 | A1* | 8/2008 | Shin | G09G 3/3648 345/94 |
| 2015/0194102 | A1* | 7/2015 | Lewis | G09G 3/3466 345/85 |
| 2016/0372038 | A1* | 12/2016 | Qian | G09G 3/3258 |

FOREIGN PATENT DOCUMENTS

| | | |
|---|---|---|
| CN | 101075410 | 11/2007 |
| CN | 101471032 | 7/2009 |
| CN | 103296055 | 9/2013 |
| CN | 103943060 | 7/2014 |

* cited by examiner

*Primary Examiner* — Shaheda Abdin

(57) ABSTRACT

A pixel compensation circuit and a display device are provided. The pixel compensation circuit and the display device include a restoring module, a data voltage writing module, a supply voltage writing module, a reference voltage writing module, a switch module, a storage capacitor, and a light-emitting device.

20 Claims, 3 Drawing Sheets

PIXEL COMPENSATION CIRCUIT AND DISPLAY DEVICE

RELATED APPLICATIONS

This application is a National Phase of PCT Patent Application No. PCT/CN2017/082821 having International filing date of May 3, 2017, which claims the benefit of priority of Chinese Patent Application No. 201710237158.4 filed on Apr. 12, 2017. The contents of the above applications are all incorporated by reference as if fully set forth herein in their entirety.

FIELD AND BACKGROUND OF THE INVENTION

The present disclosure relates to a technical field of displays, and more particularly to a pixel compensation circuit and a display device.

Organic light-emitting diodes (OLEDs) have a wide color gamut, high contrast, low power consumption, and can be foldable. Therefore, the OLEDs have a strong competitive edge in existing display devices. The technology of active-matrix organic light-emitting diodes (AMOLEDs) is one of the main development directions of flexible displays. A conventional AMOLED adopts a pixel driving structure of 2T1C, where a switch transistor, a driving transistor and a storage capacitor are used to control emission of light of a diode. However, since a threshold voltage of the driving transistor drifts easily, a driving current of the diode varies, resulting in the display device performing poorly and having a compromised picture quality.

A common existing technology adopts a driving structure of 6T1C to solve the aforementioned current variation of the diode caused by the shift of the threshold voltage. However, when a size of a power supply of a pixel is longer, the power supply of a pixel circuit would generate a larger voltage drop, which would similarly cause variation in a current of a diode, resulting in the display device performing poorly and having a compromised picture quality.

Therefore, there is a need to provide a pixel compensation circuit and a display device to solve the problems of existing technologies.

SUMMARY OF THE INVENTION

An object of the present disclosure is to provide a pixel compensation circuit and a display device, both of which not only have a function of compensating a threshold voltage, but also have a function of compensating a voltage drop on a pixel power supply line.

The present disclosure provides a pixel compensation circuit, comprising a restoring module, a data voltage writing module, a supply voltage writing module, a reference voltage writing module, a switch module, a storage capacitor, and a light-emitting device.

The restoring module is connected to a first terminal of the storage capacitor and a second terminal of the storage capacitor, and is configured to restore the storage capacitor.

The data voltage writing module is connected to the first terminal of the storage capacitor, and is configured to connect a data voltage to the first terminal of the storage capacitor in a stage before a light-emitting process of the light-emitting device.

The supply voltage writing module is connected to the second terminal of the storage capacitor, and is configured to connect a difference value between a supply voltage and a threshold voltage to the second terminal of the storage capacitor in a stage before the light-emitting process of the light-emitting device.

The reference voltage writing module is connected to the first terminal of the storage capacitor, and is configured to connect a reference voltage to the first terminal of the storage capacitor during the light-emitting process of the light-emitting device.

The switch module is connected to the supply voltage writing module, and is configured to conduct between the supply voltage writing module and the light-emitting device during the light-emitting process of the light-emitting device.

An anode of the light-emitting device is connected to the switch module, and a cathode of light-emitting device is connected a common ground electrode.

The pixel compensation circuit further comprises a first control signal source.

The restoring module comprises a first transistor, a gate of the first transistor is connected to the first control signal source, a source of the first transistor is connected to the first terminal of the storage capacitor, and a drain of the first transistor is connected to the second terminal of the storage capacitor.

The pixel compensation circuit further comprises a second control signal source, the second control signal source is connected to the supply voltage writing module and the data voltage writing module.

In the pixel compensation circuit of the present disclosure, the supply voltage writing module comprises a second transistor and a driving transistor.

A gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

In the pixel compensation circuit of the present disclosure, the data voltage writing module comprises a third transistor, a source of the third transistor receives the data voltage, a drain of the third transistor is connected to the first terminal of the storage capacitor, and a gate of the third transistor is connected to the second control signal source.

In the pixel compensation circuit of the present disclosure, the pixel compensation circuit further comprises a third control signal source, and the third control signal source is connected to the reference voltage writing module and the switch module.

In the pixel compensation circuit of the present disclosure, the reference voltage writing module comprises a fourth transistor, a source of the fourth transistor receives the reference voltage, a drain of the fourth transistor is connected to the first terminal of the storage capacitor, a gate of the fourth transistor is connected to the third control signal source.

In the pixel compensation circuit of the present disclosure, the switch module comprises a fifth transistor, a source of the fifth transistor is connected to the supply voltage writing module, a drain of the fifth transistor is connected to the anode of the light-emitting device, and a gate of the fifth transistor is connected to the third control signal source.

The present disclosure further provides a pixel compensation circuit, comprising a restoring module, a data voltage writing module, a supply voltage writing module, a reference voltage module, a switch module, a storage capacitor, and a light-emitting device.

The restoring module is connected to a first terminal of the storage capacitor and a second terminal of the storage capacitor, and is configured to restore the storage capacitor.

The data voltage writing module is connected to the first terminal of the storage capacitor, and is configured to connect a data voltage to the first terminal of the storage capacitor in a stage before a light-emitting process of the light-emitting device.

The supply voltage writing module is connected to the second terminal of the storage capacitor, and is configured to connect a difference value between a supply voltage and a threshold voltage to the second terminal of the storage capacitor in a stage before the light-emitting process of the light-emitting device.

The reference voltage writing module is connected to the first terminal of the storage capacitor, and is configured to connect a reference voltage to the first terminal of the storage capacitor during the light-emitting process of the light-emitting device.

The switch module is connected to the supply voltage writing module, and is configured to conduct between the supply voltage writing module and the light-emitting device during the light-emitting process of the light-emitting device.

An anode of the light-emitting device is connected to the switch module, and a cathode of light-emitting device is connected a common ground electrode.

In the pixel compensation circuit of the present disclosure, the pixel compensation circuit further comprises a first control signal source.

The restoring module comprises a first transistor, a gate of the first transistor is connected to the first control signal source, a source of the first transistor is connected to the first terminal of the storage capacitor, and a drain of the first transistor is connected to the second terminal of the storage capacitor.

In the pixel compensation circuit of the present disclosure, the pixel compensation circuit further comprises a second control signal source, the second control signal source is connected to the supply voltage writing module and the data voltage writing module.

In the pixel compensation circuit of the present disclosure, the supply voltage writing module comprises a second transistor and a driving transistor.

A gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

In the pixel compensation circuit of the present disclosure, the data voltage writing module comprises a third transistor, a source of the third transistor receives the data voltage, a drain of the third transistor is connected to the first terminal of the storage capacitor, and a gate of the third transistor is connected to the second control signal source.

In the pixel compensation circuit of the present disclosure, the pixel compensation circuit further comprises a third control signal source, and the third control signal source is connected to the reference voltage writing module and the switch module.

In the pixel compensation circuit of the present disclosure, the reference voltage writing module comprises a fourth transistor, a source of the fourth transistor receives the reference voltage, a drain of the fourth transistor is connected to the first terminal of the storage capacitor, a gate of the fourth transistor is connected to the third control signal source.

In the pixel compensation circuit of the present disclosure, the switch module comprises a fifth transistor, a source of the fifth transistor is connected to the supply voltage writing module, a drain of the fifth transistor is connected to the anode of the light-emitting device, and a gate of the fifth transistor is connected to the third control signal source.

According to the aforementioned object of the present disclosure, a display device is further provided. The display device comprises a pixel compensation circuit, comprising a restoring module, a data voltage writing module, a supply voltage writing module, a reference voltage writing module, a switch module, a storage capacitor, and a light-emitting device.

The restoring module is connected to a first terminal of the storage capacitor and a second terminal of the storage capacitor, and is configured to restore the storage capacitor.

The data voltage writing module is connected to the first terminal of the storage capacitor, and is configured to connect a data voltage to the first terminal of the storage capacitor in a stage before a light-emitting process of the light-emitting device.

The supply voltage writing module is connected to the second terminal of the storage capacitor, and is configured to connect a difference value between a supply voltage and a threshold voltage to the second terminal of the storage capacitor in a stage before the light-emitting process of the light-emitting device.

The reference voltage writing module is connected to the first terminal of the storage capacitor, and is configured to connect a reference voltage to the first terminal of the storage capacitor during the light-emitting process of the light-emitting device.

The switch module is connected to the supply voltage writing module, and is configured to conduct between the supply voltage writing module and the light-emitting device during the light-emitting process of the light-emitting device.

An anode of the light-emitting device is connected to the switch module, and a cathode of light-emitting device is connected a common ground electrode.

In the pixel compensation circuit of the present disclosure, the pixel compensation circuit further comprises a first control signal source.

The restoring module comprises a first transistor, a gate of the first transistor is connected to the first control signal source, a source of the first transistor is connected to the first terminal of the storage capacitor, and a drain of the first transistor is connected to the second terminal of the storage capacitor.

In the pixel compensation circuit of the present disclosure, the pixel compensation circuit further comprises a second control signal source, and the second control signal source is connected to the supply voltage writing module and the data voltage writing module.

In the pixel compensation circuit of the present disclosure, the supply voltage writing module comprises a second transistor and a driving transistor.

A gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

In the pixel compensation circuit of the present disclosure, the data voltage writing module comprises a third transistor, a source of the third transistor receives the data voltage, a drain of the third transistor is connected to the first terminal of the storage capacitor, and a gate of the third transistor is connected to the second control signal source.

In the pixel compensation circuit of the present disclosure, the pixel compensation circuit further comprises a third control signal source, and the third control signal source is connected to the reference voltage writing module and the switch module.

The pixel compensation circuit and the display device of the present disclosure connect the data voltage to the first terminal of the storage capacitor and the difference value between the supply voltage and the threshold voltage to the second terminal of the storage capacitor in the stage before the light-emitting process of the light-emitting device through the data voltage writing module and the supply voltage writing module, and connect the reference voltage to the second terminal of the storage capacitor during the light-emitting process of the light-emitting device through the reference voltage writing module. Therefore, the pixel circuit not only has the function of compensating the threshold voltage, but also has the function of compensating the voltage drop on the pixel power supply line, thereby enhancing the display quality of the display device.

In order for the foregoing content of the present disclosure to be more apparent, the following preferred embodiments with reference to the accompanying drawings are used as examples to provide a detailed description below.

BRIEF DESCRIPTION OF THE SEVERAL VIEWS OF THE DRAWINGS

In conjunction with the accompanying drawings below, the detailed description of the concrete embodiments of the present disclosure is made, so that the technical solution and other advantages of the present disclosure are obvious.

DESCRIPTION OF THE SPECIFIC EMBODIMENTS OF THE INVENTION

For the objects, the technical solution and the advantages of the present disclosure to be clearer, the accompanying drawings and embodiments provided in conjunction below facilitate a further detailed description of the present disclosure. It is to be appreciated that the concrete embodiments described herein are only used to illustrate the present disclosure, and not used to limit the present disclosure.

Figure 1:
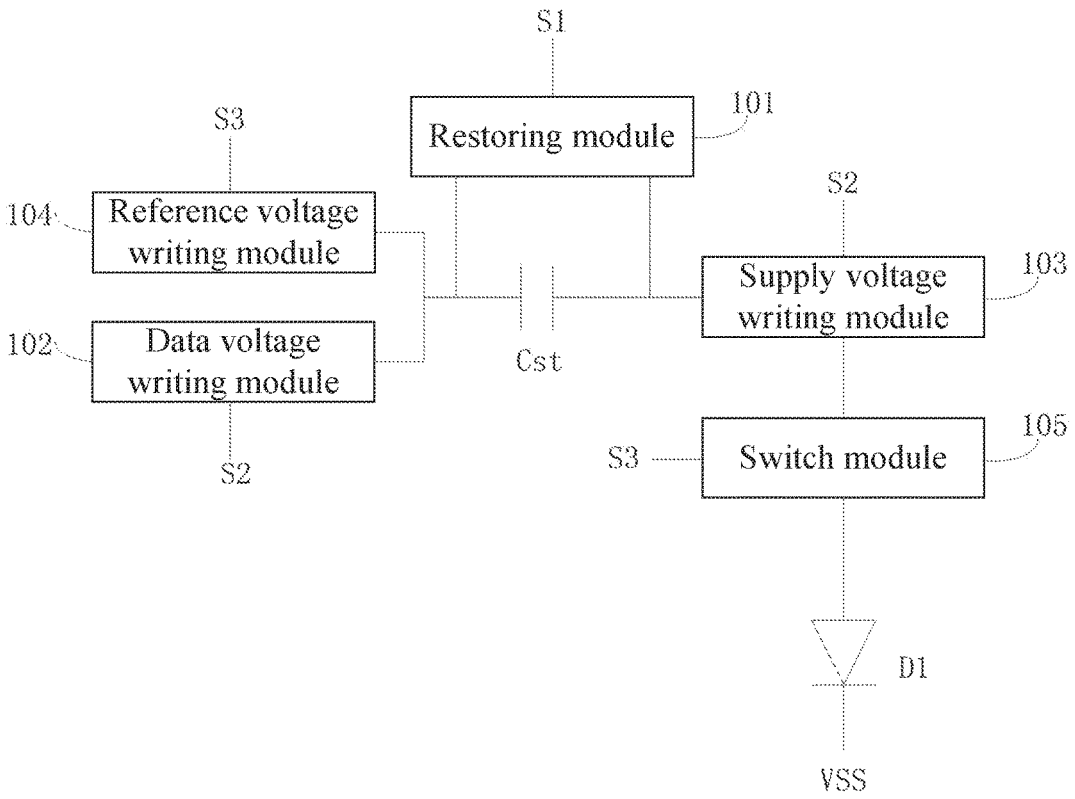
FIG. 1 is a structural block diagram of a pixel compensation circuit according to a preferred embodiment of the present disclosure.

Refer to FIG. 1, which is a structural block diagram of a pixel compensation circuit according to a preferred embodiment of the present disclosure. As shown in FIG. 1, a pixel compensation circuit according to a preferred embodiment of the present disclosure comprises a restoring module 101, a data voltage writing module 102, a supply voltage writing module 103, a reference voltage writing module 104, a switch module 105, a storage capacitor Cst and a light-emitting device D1.

The restoring module 101 is connected to a first terminal of the storage capacitor Cst and a second terminal of the storage capacitor Cst, and is configured to restore the storage capacitor Cst. The data voltage writing module 102 is connected to the first terminal of the storage capacitor Cst, and is configured to connect a data voltage to the first terminal of the storage capacitor Cst in a stage before a light-emitting process of the light-emitting device D1. The supply voltage writing module 103 is connected to the second terminal of the storage capacitor Cst, and is configured to connect a difference value between a supply voltage and a threshold voltage to the second terminal of the storage capacitor Cst in a stage before the light-emitting process of the light-emitting device D1. The reference voltage writing module 104 is connected to the first terminal of the storage capacitor Cst and is configured to connect a reference voltage to the first terminal of the storage capacitor Cst during the light-emitting process of the light-emitting device D1. The switch module 105 is connected to the supply voltage writing module 103, and is configured to conduct between the supply voltage writing module 103 and the light-emitting device D1 during the light-emitting process of the light-emitting device D1. An anode of the light-emitting device D1 is connected to the switch module 105, a cathode of the light-emitting device D1 is connected to a common ground electrode VSS.

Further, the pixel compensation circuit further comprises a first control signal source S1, a second control signal source S2, and a third control signal source S3. The first control signal source S1 is connected to the restoring module 101. The second control signal source S2 is connected to the supply voltage writing module 103 and the data voltage writing module 102. The third control signal source S3 is connected to the reference voltage writing module 104 and the switch module 105.

Figure 2:
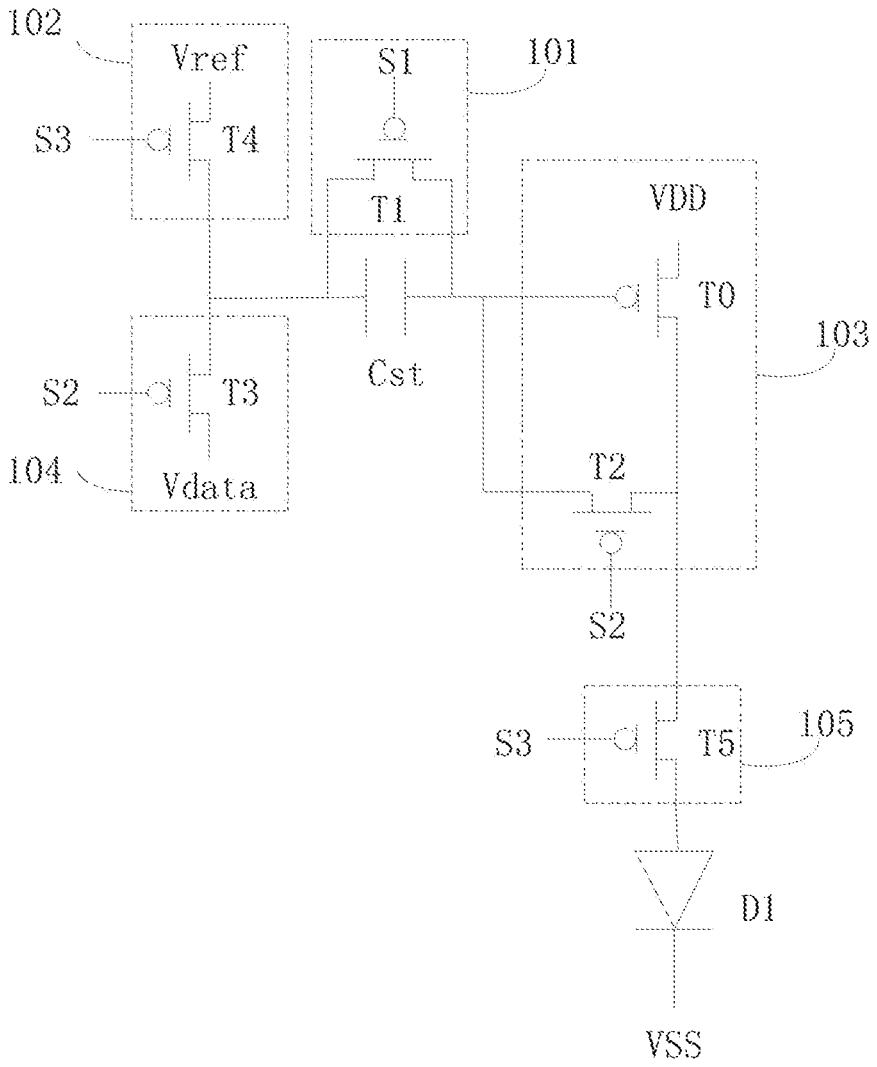
FIG. 2 is a circuit diagram of a pixel compensation circuit according to a preferred embodiment of the present disclosure.

Refer to FIG. 2 concretely, which is a circuit diagram of a pixel compensation circuit according to a preferred embodiment of the present disclosure. As shown in FIG. 2, the restoring module 101 comprises a first transistor T1, a gate of the first transistor T1 is connected to the first control signal source S1, a source of the first transistor T1 is connected to the first terminal of the storage capacitor Cst, and a drain of the first transistor T1 is connected to the second terminal of the storage capacitor Cst.

The supply voltage writing module 103 comprises a second transistor T2 and a driving transistor T0. A gate of the driving transistor T0 and a drain of the second transistor T2 are connected to the second terminal of the storage capacitor Cst, a source of the driving transistor T0 receives the supply voltage VDD, a drain of the driving transistor T0 and a source of the second transistor T2 are connected to the switch module 105, and a gate of the second transistor T2 is connected to the second control signal source S2.

The data voltage writing module 102 comprises a third transistor T3. A source of the third transistor T3 receives the data voltage Vdata, a drain of the third transistor T3 is connected to the first terminal of the storage capacitor Cst, and a gate of the third transistor T3 is connected to the second control signal source S2.

The reference voltage writing module 104 comprises a fourth transistor T4. A source of the fourth transistor T4 receives the reference voltage Vref, a drain of the fourth transistor T4 is connected to the first terminal of the storage capacitor Cst, and a gate of the fourth transistor T4 is connected to the third control signal source S3.

The switch module 105 comprises a fifth transistor T5. A source of the fifth transistor T5 is connected to the supply voltage writing module 103, a drain of the fifth transistor T5 is connected to the anode of the light-emitting device D1, and a gate of the fifth transistor T5 is connected to the third control signal source S3.

It is to be noted that the first transistor T1, the second transistor T2, the third transistor T3, the fourth transistor T4, the fifth transistor T5, and the driving transistor T0 are all P-type transistors.

Accordingly, for the reason that the present pixel compensation circuit comprises six transistors and a capacitor, the present pixel compensation circuit can be named using a common naming method of the present field as a novel 6T1C pixel compensation circuit.

Figure 3:
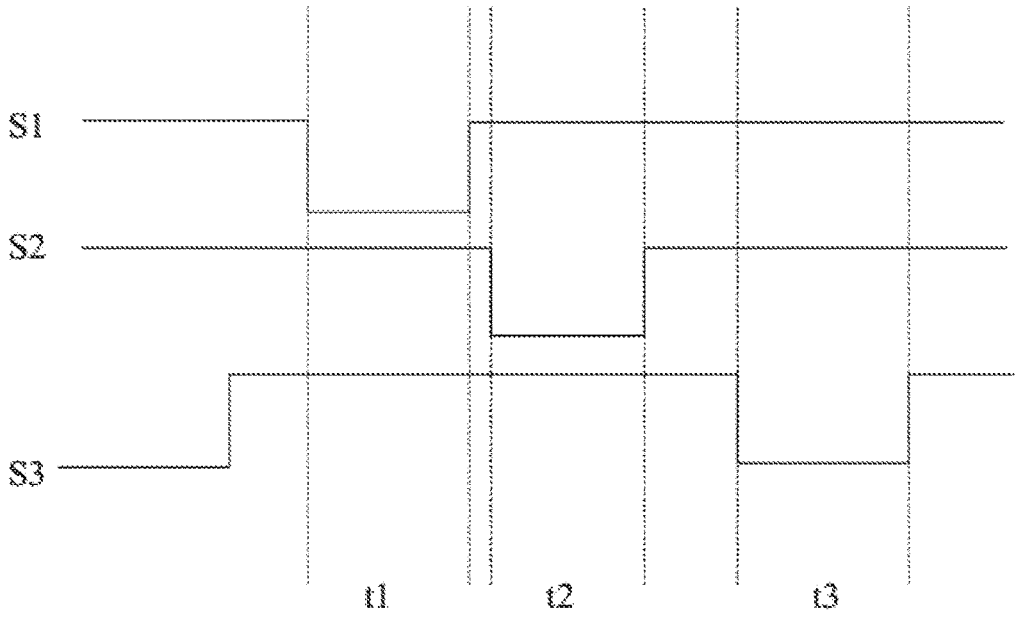
FIG. 3 is a timing diagram of a pixel compensation circuit according to a preferred embodiment of the present disclosure.

In conjunction with FIG. 3 below, the detailed description of the light-emitting process of the light-emitting device being driven by the pixel compensation circuit as illustrated in FIG. 2 is made. FIG. 3 is a timing diagram of a pixel compensation circuit according to a preferred embodiment of the present disclosure. As shown in FIG. 3, in the timing diagram of the pixel compensation circuit, the operations of the pixel compensation circuit can be generally divided into three stages: the restoring stage, the stage before the light-emitting process, and the stage of the light-emitting process.

During the restoring stage t1 and before the pixel circuit operates, the storage capacitor Cst is restored first. Concretely, the first control signal source S1 outputs a low voltage level signal, and the second control signal source S2 and the third control signal source S3 output high voltage level signals. At this time, the first transistor T1 conducts, which causes the first terminal of the storage capacitor Cst and the second terminal of the storage capacitor Cst to be shorted, thereby restoring the storage capacitor Cst.

During the stage t2 before the light-emitting process, the second control signal source S2 outputs a low voltage level signal, and the first control signal source S1 and the third control signal source S3 outputs high voltage level signals. At this time, the second transistor T2 and the third transistor T3 conduct, and the data voltage Vdata is transmitted to the first terminal of the storage capacitor Cst through the third thin film transistor T3, so that a charged voltage level at the first terminal of the storage capacitor Cst is substantially equal to the data voltage Vdata. At the same time, since the pixel compensation circuit has been restored during the restoring stage t1, the driving transistor T0 conducts at this time, and the conducting driving transistor T0 and the second transistor T2 form a current path along the source and the drain of the driving transistor T0, the source and drain of the second transistor T2 and the second terminal of the storage capacitor Cst. Because the supply voltage VDD input to the source of the driving transistor T0 is fixed, the supply voltage VDD charges the second terminal of the storage capacitor Cst, and charging sustains until a critical state is finally reached. The critical state refers to a charged voltage level at the second terminal of the storage capacitor Cst being substantially equal to the voltage source VDD subtracted by the threshold voltage Vth of the driving transistor, i.e. substantially equal to VDD−Vth, and the voltage level at the second terminal of the storage capacitor Cst directly causes the driving transistor T0 to enter a cutoff state.

During the stage t3 of the light-emitting process, the third control signal source S3 outputs a low voltage level signal, and the first control signal source S1 and the second control signal source S2 output high voltage level signals. At this time, the fourth transistor T4 and the fifth transistor T5 conduct, and the reference voltage Vref is transmitted to the first terminal of the storage capacitor Cst through the fourth transistor T4, thereby resulting in the first terminal of the storage capacitor Cst to experience an instant jump from having the data voltage Vdata to having the reference voltage Vref, and the first terminal of the storage capacitor Cst to be charged to the reference voltage Vref. By the coupling effect of the storage capacitor Cst, an actual voltage level at the second terminal of the storage capacitor Cst is substantially equal to VDD−Vth−Vdata+Vref. At the same time, the fifth transistor T5 conducts, and a current flowing through the driving transistor T0 satisfies the following function relation:

$$I_{OLED}=k(\mathrm{VDD}-(\mathrm{VDD}-|\mathrm{Vth}|+\mathrm{Vref}-\mathrm{Vdata})-|\mathrm{Vth}|)^2=k(\mathrm{Vdata}-\mathrm{Vref})^2$$

Based on a calculated result of the function relation, the current flowing through the light-emitting device is only related to the data voltage and the relatively stable reference voltage, and is not related to the threshold voltage of the driving transistor and the supply voltage with easily generated voltage drop. The pixel compensation circuit not only has the function of compensating the threshold voltage, but also has the function of compensating the voltage drop on a pixel power supply line.

The pixel compensation circuit of the present preferred embodiment connects the data voltage to the first terminal of the storage capacitor and the difference value between the supply voltage and the threshold voltage to the second terminal of the storage capacitor in the stage before the light-emitting process of the light-emitting device through the data voltage writing module and the supply voltage writing module, and connect the reference voltage to the second terminal of the storage capacitor during the light-emitting process of the light-emitting device through the reference voltage writing module. Therefore, the pixel circuit not only has the function of compensating the threshold voltage, but also has the function of compensating the voltage drop on the pixel power supply line, thereby enhancing the display quality of the display device.

The present disclosure provides a display device. In the present embodiment, the display device comprises the pixel compensation circuit according to the foregoing preferred embodiment. Concretely, the description of the pixel compensation circuit according to the foregoing preferred embodiment can be referred to, and that of the present embodiment is omitted here.

The pixel compensation circuit and display device of the present disclosure connect the data voltage to the first terminal of the storage capacitor and the difference value between the supply voltage and the threshold voltage to the second terminal of the storage capacitor in the stage before the light-emitting process of the light-emitting device through the data voltage writing module and the supply voltage writing module, and connect the reference voltage to the second terminal of the storage capacitor during the light-emitting process of the light-emitting device through the reference voltage writing module. Therefore, the pixel circuit not only has the function of compensating the threshold voltage, but also has the function of compensating the voltage drop on the pixel power supply line, thereby enhancing the display quality of the display device.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. Therefore, the protection scope of the present disclosure is in accordance with the scope defined by the claims.

What is claimed is:

1. A pixel compensation circuit, comprising:

a restoring module, a data voltage writing module, a supply voltage writing module, a reference voltage writing module, a switch module, a storage capacitor, and a light-emitting device; wherein the restoring module is connected to a first terminal of the storage capacitor and a second terminal of the storage capacitor, and is configured to restore the storage capacitor;

the data voltage writing module is connected to the first terminal of the storage capacitor, and is configured to connect a data voltage to the first terminal of the storage capacitor in a stage before a light-emitting process of the light-emitting device;

the supply voltage writing module is connected to the second terminal of the storage capacitor, and is configured to connect a difference value between a supply voltage and a threshold voltage to the second terminal of the storage capacitor in a stage before the light-emitting process of the light-emitting device;

the reference voltage writing module is connected to the first terminal of the storage capacitor, and is configured to connect a reference voltage to the first terminal of the storage capacitor during the light-emitting process of the light-emitting device;

the switch module is connected to the supply voltage writing module, and is configured to conduct between the supply voltage writing module and the light-emitting device during the light-emitting process of the light-emitting device;

an anode of the light-emitting device is connected to the switch module, and a cathode of light-emitting device is connected a common ground electrode;

the pixel compensation circuit further comprises a first control signal source;

the restoring module comprises a first transistor, a gate of the first transistor is connected to the first control signal source, a source of the first transistor is connected to the first terminal of the storage capacitor, and a drain of the first transistor is connected to the second terminal of the storage capacitor; and the pixel compensation circuit further comprises a second control signal source, and the second control signal source is connected to the supply voltage writing module and the data voltage writing module.

2. The pixel compensation circuit according to claim 1, wherein the supply voltage writing module comprises a second transistor and a driving transistor; and a gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

3. The pixel compensation circuit according to claim 1, wherein the data voltage writing module comprises a third transistor, a source of the third transistor receives the data voltage, a drain of the third transistor is connected to the first terminal of the storage capacitor, and a gate of the third transistor is connected to the second control signal source.

4. The pixel compensation circuit according claim 1, wherein the pixel compensation circuit further comprises a third control signal source, and the third control signal source is connected to the reference voltage writing module and the switch module.

5. The pixel compensation circuit according claim 4, wherein the reference voltage writing module comprises a fourth transistor, a source of the fourth transistor receives the reference voltage, a drain of the fourth transistor is connected to the first terminal of the storage capacitor, a gate of the fourth transistor is connected to the third control signal source.

6. The pixel compensation circuit according claim 4, wherein the switch module comprises a fifth transistor, a source of the fifth transistor is connected to the supply voltage writing module, a drain of the fifth transistor is connected to the anode of the light-emitting device, and a gate of the fifth transistor is connected to the third control signal source.

7. The pixel compensation circuit according to claim 1, wherein the pixel compensation circuit further comprises a third control signal source, and the third control signal source is connected to the reference voltage writing module and the switch module.

8. The pixel compensation circuit according to claim 7, wherein the reference voltage writing module comprises a fourth transistor, a source of the fourth transistor receives the reference voltage, a drain of the fourth transistor is connected to the first terminal of the storage capacitor, a gate of the fourth transistor is connected to the third control signal source.

9. The pixel compensation circuit according claim 7, wherein the switch module comprises a fifth transistor, a source of the fifth transistor is connected to the supply voltage writing module, a drain of the fifth transistor is connected to the anode of the light-emitting device, and a gate of the fifth transistor is connected to the third control signal source.

10. A pixel compensation circuit, comprising:

a restoring module, a data voltage writing module, a supply voltage writing module, a reference voltage module, a switch module, a storage capacitor, and a light-emitting device; wherein the restoring module is connected to a first terminal of the storage capacitor and a second terminal of the storage capacitor, and is configured to restore the storage capacitor;

the data voltage writing module is connected to the first terminal of the storage capacitor, and is configured to connect a data voltage to the first terminal of the storage capacitor in a stage before a light-emitting process of the light-emitting device;

the supply voltage writing module is connected to the second terminal of the storage capacitor, and is configured to connect a difference value between a supply voltage and a threshold voltage to the second terminal of the storage capacitor in a stage before the light-emitting process of the light-emitting device;

the reference voltage writing module is connected to the first terminal of the storage capacitor, and is configured to connect a reference voltage to the first terminal of the storage capacitor during the light-emitting process of the light-emitting device;

the switch module is connected to the supply voltage writing module, and is configured to conduct between the supply voltage writing module and the light-emitting device during the light-emitting process of the light-emitting device; and an anode of the light-emitting device is connected to the switch module, and a cathode of light-emitting device is connected a common ground electrode.

11. The pixel compensation circuit according to claim 10, wherein the pixel compensation circuit further comprises a first control signal source; and the restoring module comprises a first transistor, a gate of the first transistor is connected to the first control signal source, a source of the first transistor is connected to the first terminal of the storage capacitor, and a drain of the first transistor is connected to the second terminal of the storage capacitor.

12. The pixel compensation circuit according to claim 10, wherein the pixel compensation circuit further comprises a second control signal source, and the second control signal source is connected to the supply voltage writing module and the data voltage writing module.

13. The pixel compensation circuit according to claim 12, wherein the supply voltage writing module comprises a second transistor and a driving transistor; and a gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

14. The pixel compensation circuit according to claim 12, wherein the data voltage writing module comprises a third transistor, a source of the third transistor receives the data voltage, a drain of the third transistor is connected to the first terminal of the storage capacitor, and a gate of the third transistor is connected to the second control signal source.

15. A display device, comprising:

a pixel compensation circuit, comprising:

a restoring module, a data voltage writing module, a supply voltage writing module, a reference voltage writing module, a switch module, a storage capacitor, and a light-emitting device; wherein the restoring module is connected to a first terminal of the storage capacitor and a second terminal of the storage capacitor, and is configured to restore the storage capacitor;

the data voltage writing module is connected to the first terminal of the storage capacitor, and is configured to connect a data voltage to the first terminal of the storage capacitor in a stage before a light-emitting process of the light-emitting device;

the supply voltage writing module is connected to the second terminal of the storage capacitor, and is configured to connect a difference value between a supply voltage and a threshold voltage to the second terminal of the storage capacitor in a stage before the light-emitting process of the light-emitting device;

the reference voltage writing module is connected to the first terminal of the storage capacitor, and is configured to connect a reference voltage to the first terminal of the storage capacitor during the light-emitting process of the light-emitting device;

the switch module is connected to the supply voltage writing module, and is configured to conduct between the supply voltage writing module and the light-emitting device during the light-emitting process of the light-emitting device; and an anode of the light-emitting device is connected to the switch module, and a cathode of light-emitting device is connected a common ground electrode.

16. The display device according to claim 15, wherein the pixel compensation circuit further comprises a first control signal source; and the restoring module comprises a first transistor, a gate of the first transistor is connected to the first control signal source, a source of the first transistor is connected to the first terminal of the storage capacitor, and a drain of the first transistor is connected to the second terminal of the storage capacitor.

17. The display device according to claim 15, wherein the pixel compensation circuit further comprises a second control signal source, and the second control signal source is connected to the supply voltage writing module and the data voltage writing module.

18. The display device according to claim 17, wherein the supply voltage writing module comprises a second transistor and a driving transistor; and a gate of the driving transistor and a drain of the second transistor are connected to the second terminal of the storage capacitor, a source of the driving transistor receives the supply voltage, a drain of the driving transistor and a source of the second transistor are connected to the switch module, and a gate of the second transistor is connected to the second control signal source.

19. The display device according to claim 17, wherein the data voltage writing module comprises a third transistor, a source of the third transistor receives the data voltage, a drain of the third transistor is connected to the first terminal of the storage capacitor, and a gate of the third transistor is connected to the second control signal source.

20. The display device according to claim 15, wherein the pixel compensation circuit further comprises a third control signal source, and the third control signal source is connected to the reference voltage writing module and the switch module.

* * * * *